US005878645A

United States Patent [19]

Streit

[11] Patent Number: 5,878,645

[45] Date of Patent: Mar. 9, 1999

[54] ACCORDION FOLD CURTAINS AND METHOD OF MANUFACTURE

[76] Inventor: Carl Streit, 300 Castle Dr., Englewood Cliffs, N.J. 07632

[21] Appl. No.: 928,359

[22] Filed: Sep. 12, 1997

[51] Int. Cl.[6] ..... D04C 1/00

[52] U.S. Cl. ..... 87/10; 83/13; 83/936; 87/1; 87/13; 112/441; 139/383 AA; 160/84.01

[58] Field of Search ..... 87/10, 1, 13; 160/84.01, 160/84.04, 330; 83/13, 29, 50, 55, 936; 139/383 AA; 66/172 R; 112/441

[56] References Cited

U.S. PATENT DOCUMENTS

| | | | |
|---|---|---|---|
| Re. 15,196 | 9/1921 | Schloss . | |
| 1,335,627 | 3/1920 | Waterfield . | |
| 1,569,140 | 1/1926 | Querns | 66/202 |
| 1,958,436 | 5/1934 | Hess | 156/10 |
| 1,959,137 | 5/1934 | Miller | 156/14 |
| 2,017,830 | 10/1935 | Geller | 156/10 |
| 2,083,991 | 6/1937 | Geller | 156/10 |
| 2,123,413 | 7/1938 | Geller | 156/10 |
| 2,167,651 | 8/1939 | Hess | 156/10 |
| 2,829,081 | 4/1958 | Sweem | 154/118 |
| 3,321,781 | 5/1967 | Reich | 4/154 |
| 3,511,745 | 5/1970 | Holzknecht | 161/142 |
| 3,775,235 | 11/1973 | Howell | 161/70 |
| 3,819,461 | 6/1974 | Saffadi | 161/58 |
| 4,095,622 | 6/1978 | MacBean | 139/383 AA |
| 4,123,022 | 10/1978 | Dutt et al. | 139/383 AA |
| 4,401,137 | 8/1983 | Cannon | 139/383 AA |
| 4,550,038 | 10/1985 | Becker et al. . | |
| 5,514,438 | 5/1996 | Crook | 139/383 AA |

FOREIGN PATENT DOCUMENTS

| | | | |
|---|---|---|---|
| 1225925 | 8/1987 | Canada . | |
| 2754804 | 6/1979 | Germany | 160/84.04 |
| 62-127019 | 6/1987 | Japan | 160/84.04 |
| 2201583 | 9/1988 | United Kingdom | 160/84.04 |

*Primary Examiner*—William Stryjewski
*Attorney, Agent, or Firm*—Abelman, Frayne & Schwab

[57] ABSTRACT

A method for forming a ready-to-hang lace curtain and a lace curtain comprising stiffen vertical panel of woven fabric. Each panel being joined to an adjacent panel by an integrally woven vertical zone of open mesh. The open mesh zones formed from a plurality of threads twisted into a single vertical strand. The strand being joined to adjacent vertical panels at evenly spaced intervals by a single loop of thread draw from the vertical strand and extending generally horizontally. The loops being interwoven at spaced locations into the edge of the adjacent vertical panel. Forming an accordion-folding of the plurality of the vertical panels along the mesh zones into aligned and compact stacked assembly and simultaneously die-cutting an opening through the assembled panels while they are in the stacked aligned configuration. The opening configured to receive means for hanging the curtain.

16 Claims, 3 Drawing Sheets

FIG. 1
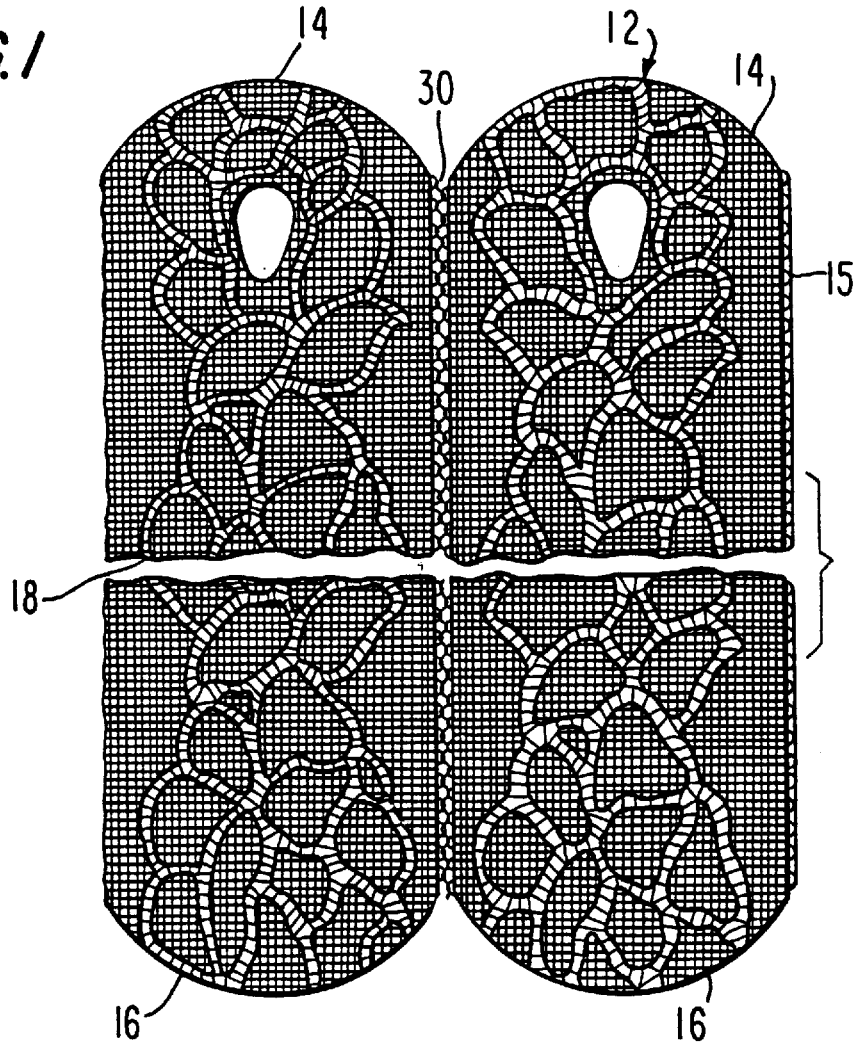
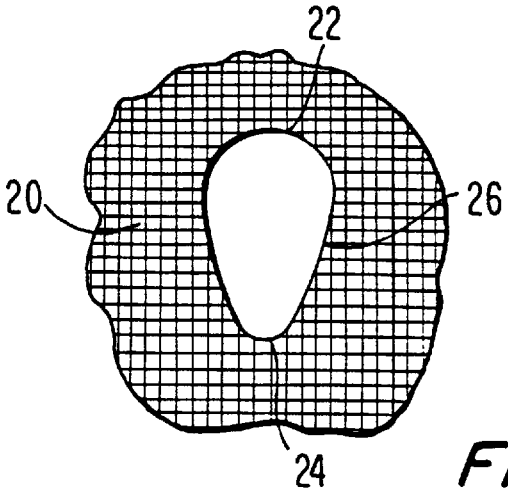
FIG. 2

FIG.3
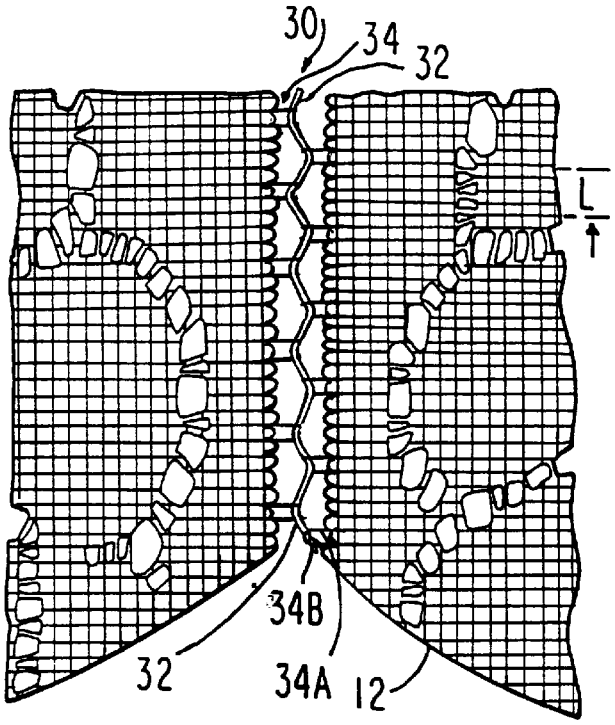
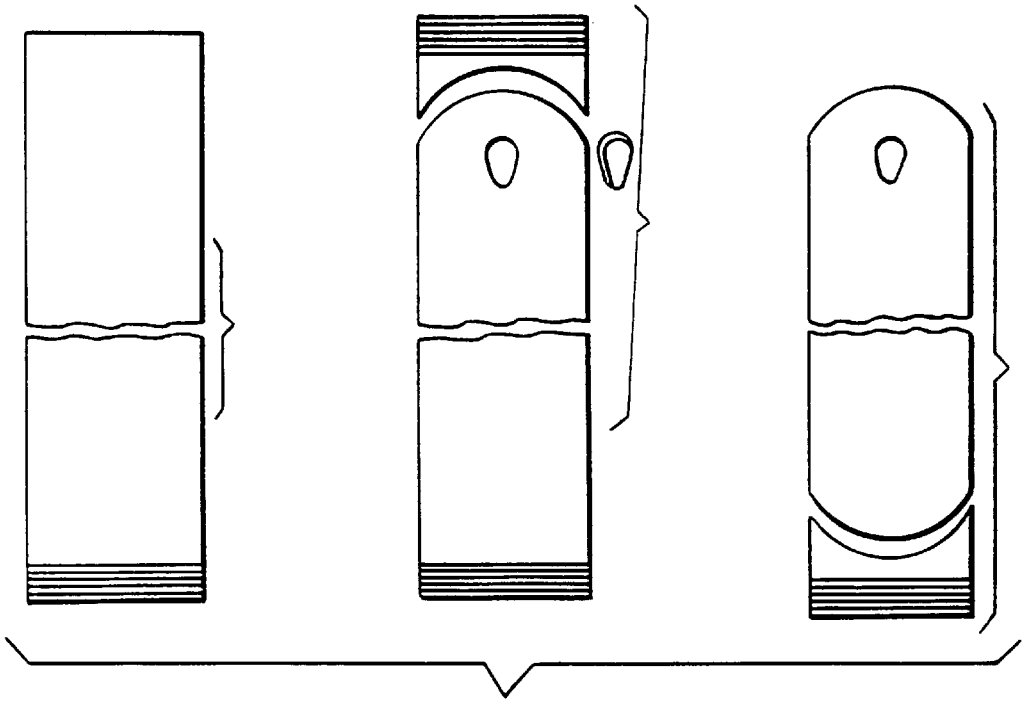
FIG.5

ACCORDION FOLD CURTAINS AND METHOD OF MANUFACTURE

FIELD OF INVENTION

The invention relates to improvements in woven lace fabric window and shower curtains that are formed from stiffened vertical panels joined by integrally woven vertical zones of open mesh, and the methods of manufacturing such curtains.

BACKGROUND OF THE INVENTION

Woven lace curtains comprised of patterned vertical panels joined by integrally woven vertical zones of open mesh are known in the art, for example, as disclosed in my Canadian patent No. 1,225,929. In order to suspend the prior art curtain from a rod or pole, an opening was integrally woven into each of the panels at the time of manufacture. Thereafter, the woven fabric was treated with a finishing agent to stiffen the entire curtain so that the panels would hang vertically to permit the decorative pattern to be seen and enjoyed when the curtain was in the extended position, and equally as importantly, to permit the panels to lay flat against each other when accordion-folded against the frame at the side of the window.

Curtains of the prior art construction with integrally woven openings for the curtain rod did not provide a consistent and uniform appearance when in the extended, or partially extended position. This was because the weaving of the openings could not be done with absolute precision from panel to panel, and also because of the uneven forces applied to the areas around the openings when the curtain was manually moved along the rod. As a result, panels hung at different heights, which was readily apparent to even a casual observer, since both the top and bottom edges of the stiffened panels were out of alignment.

The lack of uniform alignment of the panels of the prior art curtains was also attributable to the construction of the vertical zones of open mesh that provided the flexibility of a hinge that allowed the panels to be positioned in compact, accordion-folded alignment. The open mesh construction consisted of a vertical twisted strand formed from a plurality of individual threads. At regular, alternating intervals, a thread was drawn from the strand and interwoven into an adjacent panel. However, the thread extended into the panel at a single point of entry. This construction provided uneven vertical support between the panels, and allowed adjacent panels to hang at uneven heights.

It is therefore, an object of the invention to provide an improved curtain in which the individual panels maintain a visual alignment when supported on a curtain rod or pole.

It is another object of the invention to provide an improved construction to the vertical zone of woven open mesh that will provide increased vertical support to adjacent panels of the stiffened fabric and thereby assist in maintaining the visual alignment over the life and use of the curtains.

Another object of the invention is to provide improved methods of manufacture of such curtains that are faster, more efficient and less expensive than the methods of the prior art.

A further object of the invention is to provide improved curtains having an extended useful life, and which require no wands, clips, pulleys or other accessory components for their use and installation.

SUMMARY OF THE INVENTION

The above objects and advantages, and others are obtained by providing a curtain in which the openings for supporting the curtain are die-cut in the panels when the panels are in a compact stacked and aligned configuration. The die-cutting of the curtain rod opening is accomplished after the curtain fabric has been treated with a finishing agent, e.g., a melamine-based stiffening solution, and dried, to produce the stiffened and semi-rigid panels. When the stiffened panels are accordion or fan-folded, the stacked panels are aligned and compacted, and then die-cut simultaneously in a single operation.

In a preferred embodiment of the invention, the top contour of the curtain is also simultaneously die-cut. In this way, the spacial relation of the rod or hanger opening and the top of the curtain are not subject to variation, for example, as between separate sets of curtains.

In a further preferred embodiment of the invention, the vertical woven open mesh zone between the panels is formed from a plurality of threads twisted into a single vertical strand, said strand being joined to adjacent vertical panels at evenly spaced intervals by a single open loop of thread drawn from the vertical strand and extending generally horizontally, the upper and lower arms of said loop being interwoven into the edge of the adjacent vertical panel, thereby forming two points of connection with the panel.

BRIEF DESCRIPTION OF THE DRAWINGS

The invention and its preferred embodiments will be set forth with reference to the attached drawing in which FIG. 1 is a front view of a portion of two adjacent panels of a window curtain in accordance with the invention;

FIG. 2 is an enlarged view of the die-cut opening of FIG. 1;

FIG. 3 is an enlarged view of the woven vertical open mesh zone between the panels;

FIG. 5 is a schematic view of the die-cutting of a curtain.

DETAILED DESCRIPTION OF THE INVENTION

Figure 4:
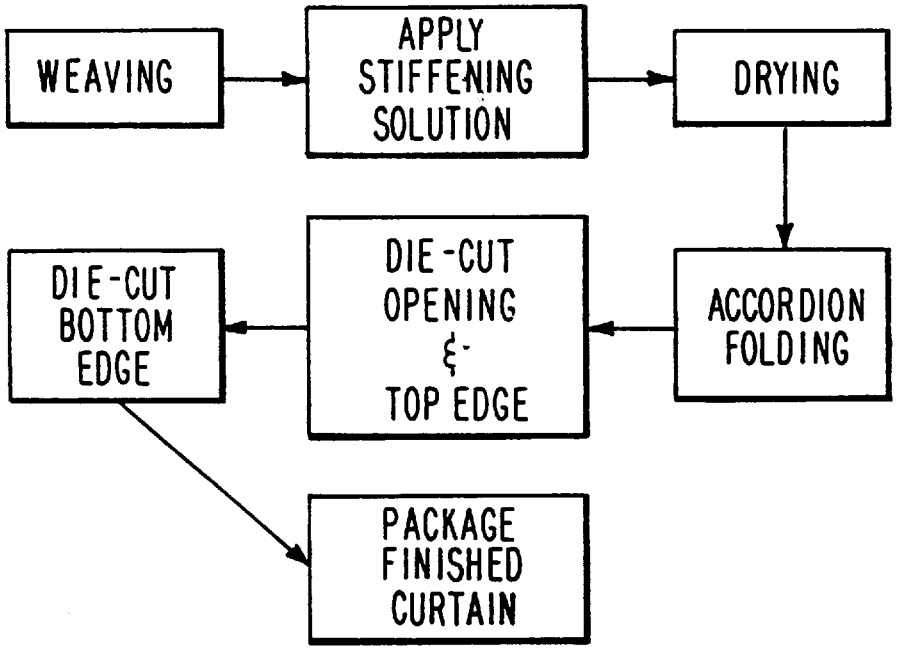
FIG. 4 is a schematic drawing of one embodiment of the method of the invention.

With reference to FIG. 1, there are shown two panels from a typical woven lace fabric, including an end panel with selvage edge 15 and an adjacent interior panel. The curtain is comprised of vertical panels 12 which, for example, have scalloped top edges 14 and bottom edges 16, and incorporate an ornamental design or pattern 18. The panels 12 are joined along an integrally woven vertical zone of open mesh 30, which permits the panels to be fan or accordion folded in an overlying or stacked array. Woven mesh zone 30 is formed form a plurality of threads that are twisted into a single strand 32 which is joined to adjacent panels 12 at evenly spaced intervals "L" by an open loop 34 formed by a single thread. The loop 34 is drawn from the strand 32, extends generally horizontally and the upper and lower arms of the loop are interwoven with the edge of the panel 12 to which it is connected at two spaced apart positions.

As best shown in FIG. 3, the upper loop arm 34A is spaced apart from the lower loop arm 34B and forms a clearly open space. When the woven fabric is treated with a stiffening agent, such as melamine, the arms 34A and 34B, in combination with the stranded threads 32, form a rigid supporting structure that maintains the proper side-by-side alignment of the panels 12.

Also as shown in FIG. 3, the length of the loops 34 are preferably less than one-half the distance between the panels 12. This results in a zig-zag appearance of strand 32 since the loops 34 are positioned on alternate sides of the strand 32. This result is achieved by providing a loop that has a horizontal length of from about 25% to about 40% of the distance between the panels 12, and preferably about 35%.

As will be understood by one familiar with the art, the relative size and spacing of the panels 12 and the woven zones 30 are based in part on aesthetic considerations. The overall dimensions of the finished curtain panels, i.e., relatively small panels for residential windows, somewhat larger panels for shower curtains, and very large panels for commercial and institutional use, must also be taken into consideration. For conventional window curtains, panels 12 can range in width from about two to twelve inches and woven zone 30 from about 0.125 to about 1.5 inches.

The woven lace fabric can be produced from any materials that can be subsequently finished with a stiffening agent. Polyester and its blends are relatively inexpensive and when treated with a melamine stiffener produce a long-lasting, durable and washable curtain.

With reference to FIG. 2, the opening 20 for receiving the curtain rod, as for window curtains, is preferably oblong or elliptical. The upper portion is generally semi-circular and is preferred for hanging on round curtain rods, although the height of the opening 20 permits hanging on rods having a C-shaped or rectangular cross-section. The opening is preferably about 1.5 inches at its widest and about one inch high.

If the curtain is to be hung on a shower rod using conventional loops, the holes can be round, about 0.25 inches in diameter and spaced from about one-half to one inch from the upper edge of the panel. The hole can be die-cut to a larger and/or different configuration if it is desired to suspend the shower curtain from its own rod, or other custom fixture.

In a preferred embodiment, shown in FIG. 2, the area around the opening 20 is of uniform weave, i.e., it has no open decorative pattern, in order to provide uniform support on the rod or shower curtain rings.

In the method of the invention, the step-wise manufacture of the improved curtains differs by providing the curtains with the opening 20 at the final stages of production. As shown in the schematic drawing of FIG. 4, the woven lace fabric is dyed and finished in accordance with convention techniques and then finished with a stiffening agent, e.g., melamine. The stiffened fabric is then accordion folded across its width, e.g., about 58 to 60 inches for window curtains and about 120 inches for shower curtains, the fabric selvage providing finished edges for the curtain. The stacked panels are aligned, compacted and die-cut in a single stroke along the centerline of the panels, thereby providing for the uniform alignment of the panels on the rod or rings.

In a preferred embodiment, each of the panels are provided with a curved top edge 14 which produces a scalloped effect when the curtain is extended. In the preferred embodiment of the invention, the top edge 14 and the opening 20 are die-cut simultaneously, thereby assuring uniform alignment of the opening with respect to the adjacent tope edge 14 in all panels.

The die-cutting of the bottom edge 16 of panels 12 is also advantageously accomplished in the same step as the opening 20 and top edge 14 are provided. The completed panels can then be packaged, for example, in clear protective plastic bags which are also suitable for displaying the product at retail stores.

I claim:

1. A lace curtain comprising vertical panels of woven fabric having a stiffened finish, each panel being joined to an adjacent panel by an integrally woven vertical zone of open mesh, said panels being substantially wider than said zones, said panels being foldable in an accordion fashion with the fold lines being along said open mesh zones, the improvement comprising forming the open mesh zone from a plurality of threads twisted into a single vertical strand, said strand being joined to adjacent vertical panels at evenly spaced intervals by a single loop of thread drawn from the vertical strand and extending generally horizontally, said loop being interwoven at spaced locations into the edge of the adjacent vertical panel.

2. The curtain of claim 1 where the vertical distance between the horizontal loops along the twisted strand ranges from about 0.125 inches to about one-half inch.

3. The curtain of claim 2 where the distance is about 0.35 to about 0.40 inches.

4. The curtain of claim 2 where the distance between the panels is about 0.15 to about 0.20 inches.

5. The curtain of claim 4 where the vertical panels and vertical strand are polyester.

6. The curtain of claim 1 where the vertical panels and the threads of the vertical strand are the same material.

7. The curtain of claim 1 where the panels and open mesh zone are stiffened with a melamine finishing agent.

8. The curtain of claim 1 which includes die-cut openings in spaced relation to the upper edge of the vertical panels for receiving means for hanging the curtain.

9. A method of forming a flexible foldable woven zone between an adjacent pair of stiffened vertical woven window curtain panels, the method comprising:

(a) forming a twisted vertical strand from a plurality of threads, (b) forming a first loop extending horizontally from one of the threads in the vertical strand;

(c) interweaving said first horizontal loop into the edge of a first adjacent panel;

(d) forming a second horizontally extending loop from one of the threads in the vertical strand at a predetermined vertical distance from the first loop;

(e) interweaving said second horizontal loop into the edge of the other adjacent panel;

(f) repeating steps (b) through (e) along the vertical strand until the vertical panels are joined along their length.

10. The method of claim 9 where the length of the horizontal loops is less than one-half the distance between adjacent panels.

11. The method of claim 10 where the length of the horizontal loop is about 35% of the distance between adjacent panels.

12. The method of claim 9 that is practiced on an automatic lace-making machine.

13. The method of claim 9 which comprises the further steps of aligning a plurality of accordion folded panels in stacked relation and simultaneously die-cutting an opening in the stacked panels, said opening configured to receive means for hanging the curtain.

14. The method of claim 13 which includes the step of die-cutting the top and bottom edges of the vertical panels in a predetermined contour.

15. The method of claim 14 where the die-cutting of the opening and the top edge of the panels is performed simultaneously.

16. The method of claim 13 where the vertical panels comprise an open pattern area adjoining a closely-woven area proximate the panel top edge and the opening is cut through the closely-woven area.

* * * * *

UNITED STATES PATENT AND TRADEMARK OFFICE

CERTIFICATE OF CORRECTION

PATENT NO. : 5,878,645
DATED : March 9, 1999
INVENTOR(S) : Carl Streit

It is certified that error appears in the above-identified patent and that said Letters Patent is hereby corrected as shown below:

On the cover page of the patent, replace the Abstract with the following:

ABSTRACT

A method is disclosed for forming a ready-to-hang lace curtain and a lace curtain which includes stiffened vertical panels of woven fabric, each panel being joined to an adjacent panel by an integrally woven vertical zone of open mesh. The open mesh zones are formed from a plurality of threads twisted into a single vertical strand, the strand being joined to adjacent vertical panels at evenly spaced intervals by a single loop of thread drawn from the vertical strand and extending generally horizontally, and being interwoven at spaced locations into the edge of the adjacent vertical panel. A plurality of the vertical panels are accordion folded along the mesh zones into an aligned and compact stacked assembly. An opening is simultaneously die-cut through the assembled panels while they are in the stacked aligned configuration.

UNITED STATES PATENT AND TRADEMARK OFFICE

CERTIFICATE OF CORRECTION

PATENT NO. : 5,878,645

DATED : March 9, 1999

INVENTOR(S) : Carl Streit

It is certified that error appears in the above-indentified patent and that said Letters Patent is hereby corrected as shown below:

The die-cut opening is configured to receive means for hanging the curtain.

Signed and Sealed this

Twelfth Day of October, 1999

*Attest:*

*Attesting Officer*

Q. TODD DICKINSON

*Acting Commissioner of Patents and Trademarks*